US010905204B2

(12) United States Patent
Kondo et al.

(10) Patent No.: US 10,905,204 B2
(45) Date of Patent: Feb. 2, 2021

(54) PULL AND MANUFACTURING METHOD OF PULL

(71) Applicant: YKK CORPORATION, Tokyo (JP)

(72) Inventors: Yuji Kondo, Taipei (TW); Wei Chen Yeh, Taipei (TW); Chin Wen Yen, Taipei (TW)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 16/656,593

(22) Filed: Oct. 18, 2019

(65) Prior Publication Data

US 2020/0128925 A1 Apr. 30, 2020

(30) Foreign Application Priority Data

Oct. 30, 2018 (CN) ..... 2018 1 1275569

(51) Int. Cl.
*A44B 19/26* (2006.01)
*A44B 19/42* (2006.01)

(52) U.S. Cl.
CPC ..... *A44B 19/262* (2013.01); *A44B 19/42* (2013.01)

(58) Field of Classification Search
CPC .... A44B 19/262; A44B 19/42; Y10T 24/2586
See application file for complete search history.

(56) References Cited

U.S. PATENT DOCUMENTS

2006/0249662 A1* 11/2006 Turner ..... H05B 45/00 250/221
2007/0271743 A1* 11/2007 Chou ..... H01Q 1/273 24/431

FOREIGN PATENT DOCUMENTS

| | | | | |
|---|---|---|---|---|
| GB | 2541700 A | * | 3/2017 | ..... A44B 19/262 |
| JP | 3101744 | | 6/2004 | |
| JP | 2007292796 | | 11/2007 | |
| JP | 2009187580 | | 8/2009 | |
| JP | 3204785 | | 6/2016 | |

* cited by examiner

*Primary Examiner* — Robert Sandy
(74) *Attorney, Agent, or Firm* — JCIPRNET

(57) ABSTRACT

The disclosure provides a pull and a manufacturing method of the pull, which can mount an electronic component inside a handle part without damaging the electronic component and have favorable electronic functions. The pull of the disclosure is to be mounted on a slider for a slide fastener, and includes a ring part, an insertion part, the handle part, and the electronic component. The ring part is to be mounted on the slider. The insertion part is connected to the ring part for receiving an injection material. The handle part is formed sequentially on the insertion part by the injection material. The electronic component is mounted inside the handle part in a process in which the handle part is formed sequentially on the insertion part by the injection material.

7 Claims, 4 Drawing Sheets

PULL AND MANUFACTURING METHOD OF PULL

CROSS-REFERENCE TO RELATED APPLICATION

This application claims the priority benefits of China Patent Application No. 201811275569.3, filed on Oct. 30, 2018. The entirety of the above-mentioned patent application is hereby incorporated by reference herein and made a part of this specification.

BACKGROUND

Technical Field

The disclosure relates to a pull and a manufacturing method of the pull.

Description of Related Art

The common slide fastener usually includes a pair of fastener chains composed of fastener tapes and elements, and a slider mounted on the fastener chains to slide to open or close the elements. Further, a pull can be disposed on the slider as required so that the user can pull the pull to slide the slider on the fastener chains. Besides the general use of slide fasteners, the technology of combining an electronic component with the slide fastener is also receiving increasing attention.

For example, Patent Document 1 has disclosed a general technique of embedding a radio frequency identification (RFID) chip for near field communication (NFC) as an identification medium in the upper stopper, the box body, the lower stopper, the fastener elements, the slider body, or the pull of a slide fastener. Patent Document 2 has disclosed a general technique of a replaceable insert body that houses an IC (integrated circuit) tag incorporating therein an IC chip. Patent Document 3 has disclosed a general technique of a clothing accessory such as a button or a zipper head that incorporates a near field communication module therein. Patent Document 4 has disclosed a general technique of housing electronic components in the concaves of an upper substrate and a lower substrate. Thereby, for example, electronic components for near field wireless communication or other purposes can be applied to clothing accessories such as slide fasteners to increase the application of the clothing accessories such as slide fasteners and the used garments (such as a jacket, but not limited thereto).

RELATED ART

Patent Document

[Patent Document 1] Japanese Patent Publication No. JP 2009-187580

[Patent Document 2] Japanese Patent Publication No. JP 2007-292796

[Patent Document 3] Japanese Utility Model Registration No. JP 3204785

[Patent Document 4] Japanese Utility Model Registration No. JP 3101744

As can be known from the above, in order to make the product aesthetic, the electronic component is usually embedded inside the clothing accessories such as slide fasteners. For example, the electronic component may be embedded inside the clothing accessories such as slide fasteners by an injection molding process. However, an electronic component that serves as an identification medium or a communication module may include an antenna part. When such an electronic component is embedded in the clothing accessories such as slide fasteners by the injection molding process, the antenna part may be easily damaged by the heat of the injection material, which may adversely affect the electronic component embedded in the clothing accessories.

SUMMARY

The disclosure provides a pull to be mounted on a slider for a slide fastener. The pull includes: a ring part to be mounted on the slider; an insertion part connected to the ring part for receiving an injection material; a handle part formed sequentially on the insertion part by the injection material; and an electronic component mounted inside the handle part in a process in which the handle part is formed sequentially on the insertion part by the injection material.

The disclosure provides a manufacturing method of a pull that is to be mounted on a slider for a slide fastener. The manufacturing method includes: providing a ring part to be mounted on the slider, and an insertion part connected to the ring part for receiving an injection material; and forming a handle part sequentially on the insertion part by the injection material, and mounting an electronic component inside the handle part in a process of forming the handle part sequentially on the insertion part by the injection material.

DESCRIPTION OF THE EMBODIMENTS

In an embodiment of the disclosure, the handle part includes a first injection part and a second injection part. The first injection part is formed on the insertion part to house the electronic component, and the second injection part is formed on the first injection part to bury the electronic component without a gap.

In an embodiment of the disclosure, the insertion part has an opening, and the first injection part formed on the insertion part covers and fills the opening.

In an embodiment of the disclosure, the electronic component includes an antenna part and is housed in the first injection part with the antenna part facing the first injection part so that the second injection part is not in contact with the antenna part.

In an embodiment of the disclosure, the first injection part includes a receiving part and a fixing part corresponding to opposite two ends. The receiving part is a concave structure for housing the electronic component, and the fixing part is a convex structure for fixing the insertion part.

In an embodiment of the disclosure, the handle part includes a first injection part and a second injection part. In the process of forming the handle part sequentially on the insertion part by the injection material, the first injection part is formed on the insertion part to house the electronic component, and the second injection part is formed on the first injection part to bury the electronic component without a gap.

Based on the above, the pull of the disclosure can be used on a slider for a slide fastener and mounted with the electronic component, wherein the handle part is formed sequentially on the insertion part by the injection material, and the electronic component is mounted inside the handle part in the process of sequentially forming the handle part on the insertion part by the injection material. That is, since the handle part is formed sequentially on the insertion part by the injection material, the electronic component can be mounted on the injection material that has already been formed on the insertion part when the injection material is in a stable state (cooled and fixed in shape, for example). The electronic component is then covered by the subsequently formed injection material to be mounted inside the handle part. Thus, the electronic component can be mounted inside the handle part without being damaged, and therefore, the pull of the disclosure has favorable electronic functions.

Figure 1:
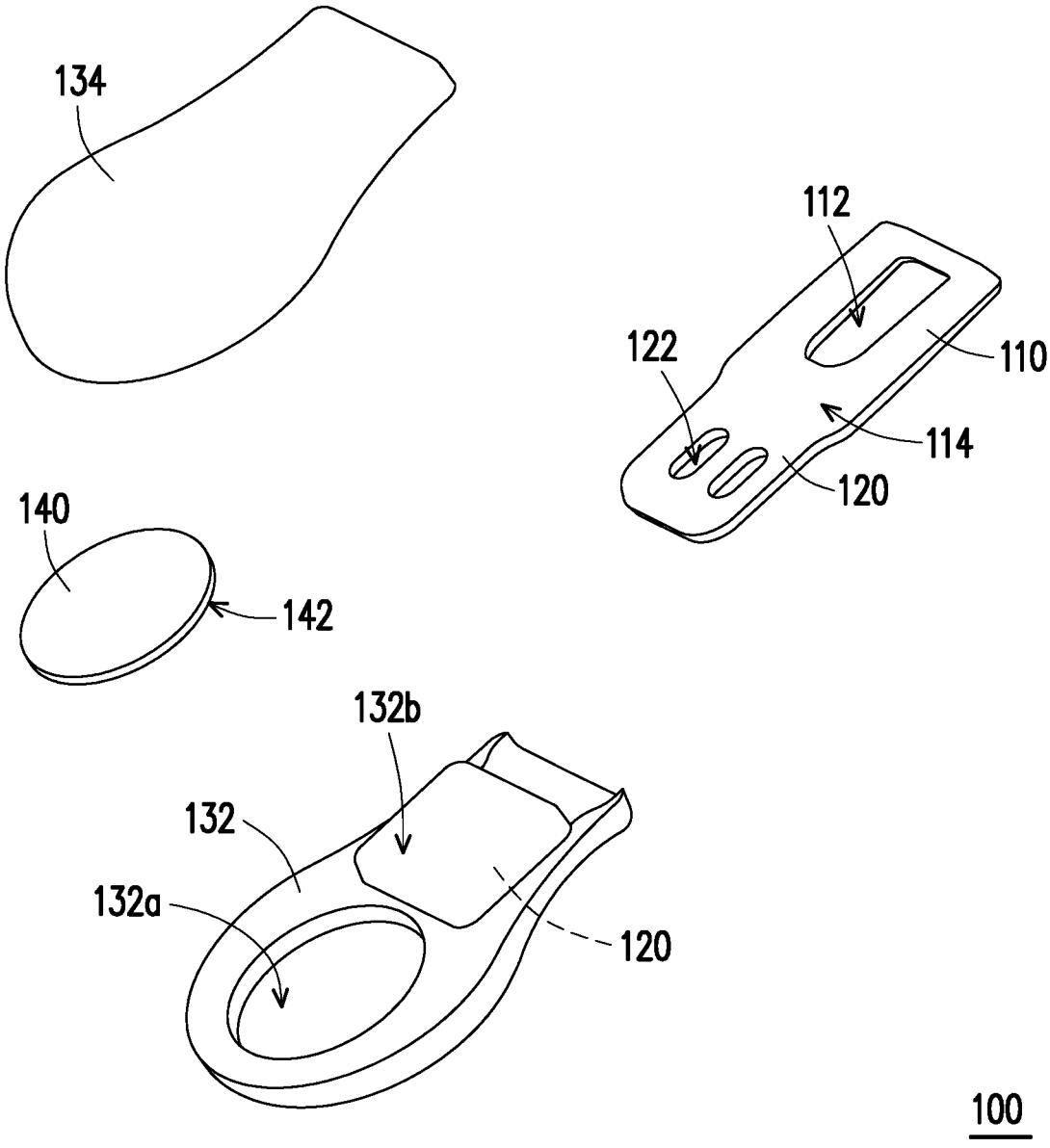
FIG. 1 is an exploded perspective view of the pull according to an embodiment of the disclosure.
Figure 3:
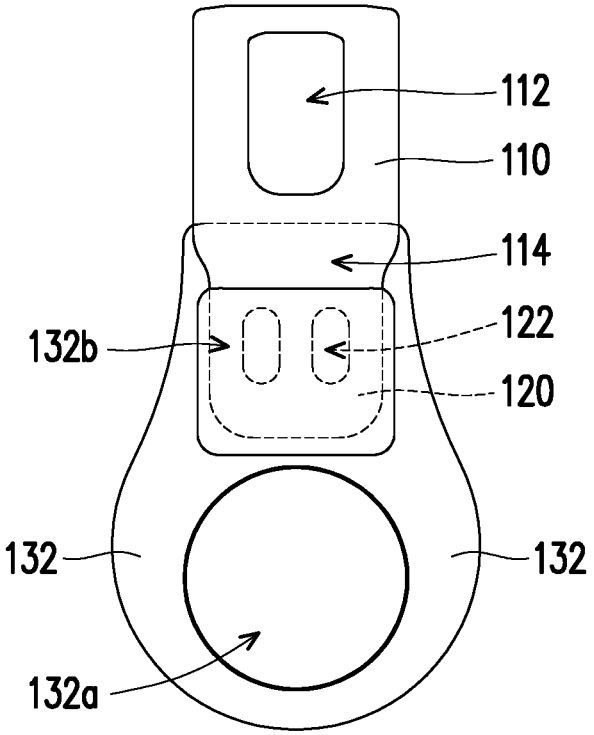
FIG. 3 is a partial schematic view of the pull in the process of FIG. 2B.
Figure 4:
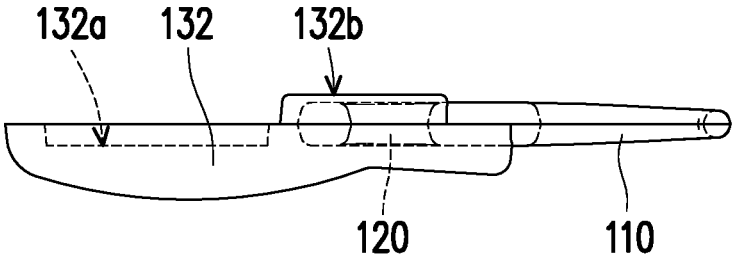
FIG. 4 is another partial schematic view of the pull in the process of FIG. 2B.

FIG. 1 is an exploded perspective view of a pull according to an embodiment of the disclosure. FIG. 2A to FIG. 2D are schematic views of the pull of FIG. 1 in the processes of a manufacturing method. FIG. 3 is a partial schematic view of the pull in the process of FIG. 2B. FIG. 4 is another partial schematic view of the pull in the process of FIG. 2B. The pull 100 shown in FIG. 1 to FIG. 4 is to be mounted on a slider for a slide fastener. Further, in terms of the technology of slide fasteners (not shown), the slide fastener has various forms such as an externally used slide fastener, an internally used slide fastener, a hidden slide fastener, and a two-way separator slide fastener. The slide fastener usually includes a pair of fastener chains with elements, and a slider mounted on the fastener chains. A pull can be further mounted on the slider. Thereby, the slider slides on the fastener chains in conjunction with the pull to open or close the elements. However, the disclosure is not intended to limit the use of the pull 100, which can be adjusted as required.

As shown in FIG. 1, in the present embodiment, the pull 100 includes a ring part 110, an insertion part 120, a handle part 130, and an electronic component 140. The ring part 110 is to be mounted on a slider (not shown). The insertion part 120 is connected to the ring part 110 to receive an injection material. The handle part 130 is formed sequentially on the insertion part 120 by the injection material. The electronic component 140 is mounted inside the handle part 130 in the process of forming the handle part 130 sequentially on the insertion part 120 by the injection material. Further, the ring part 110 functions as a mounting portion for mounting the pull 100 on the slider, and the handle part 130 formed on the insertion part 120 functions as a pulling portion for the user to pull the pull 100. In addition, the handle part 130 includes a first injection part 132 and a second injection part 134, and the electronic component 140 is mounted between the first injection part 132 and the second injection part 134 without contacting the ring part 110 and the insertion part 120. The processes of the method of manufacturing the pull 100 will be described below with reference to FIG. 2A to FIG. 2D, and the structural features of each part will be described with reference to FIG. 1, FIG. 3, and FIG. 4.

Figure 2A:
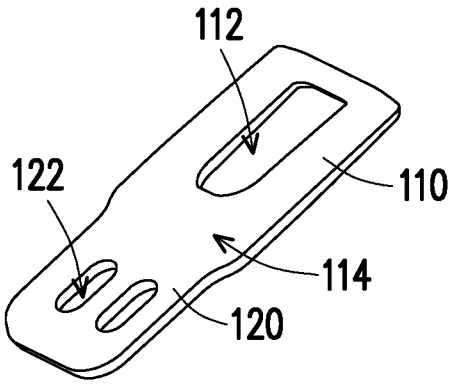
FIG. 2A to FIG. 2D are schematic views of the pull of FIG. 1 in the processes of the manufacturing method.

First, FIG. 2A shows a process of providing the ring part 110 to be mounted on the slider, and the insertion part 120 connected to the ring part 110 for receiving the injection material. Specifically, the ring part 110 and the insertion part 120 are opposite two portions of the same plate, for example (as shown in FIG. 1 and FIG. 2A). A portion of the plate has an opening 112, and this portion constitutes the ring part 110 so that the ring part 110 can be mounted on the slider through the opening 112. In addition, another portion of the plate has openings 122, and this portion constitutes the insertion part 120 so that the injection material subsequently formed on the insertion part 120 can cover the insertion part 120 and further fill the openings 122. Although two openings 122 are used in the present embodiment, the number can be adjusted as required. In addition, although the ring part 110 and the insertion part 120 of the present embodiment are opposite two portions of the same plate, in other embodiments not shown, the ring part 110 and the insertion part 120 may be two members connected to each other. Nevertheless, the disclosure is not limited thereto.

Figure 2B:
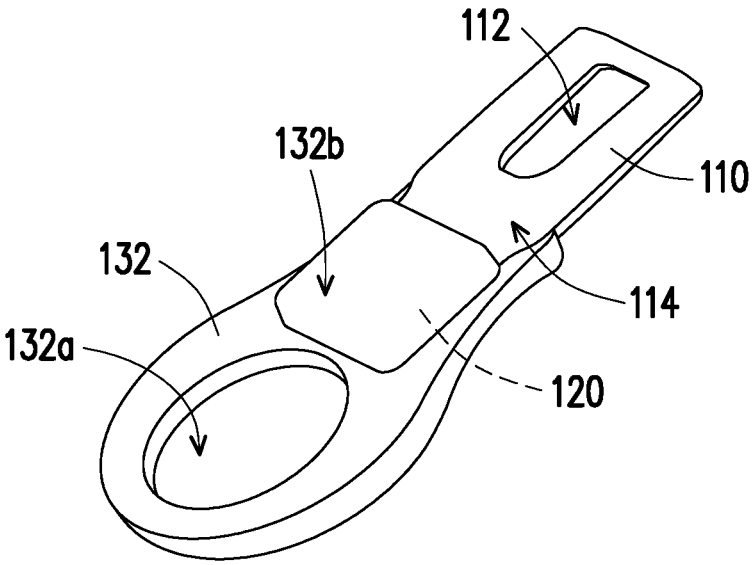
Figure 2C:
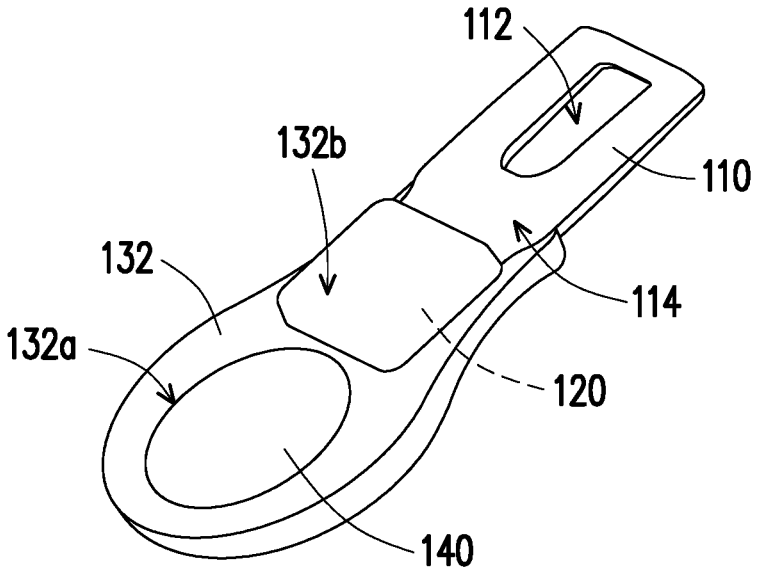
Figure 2D:
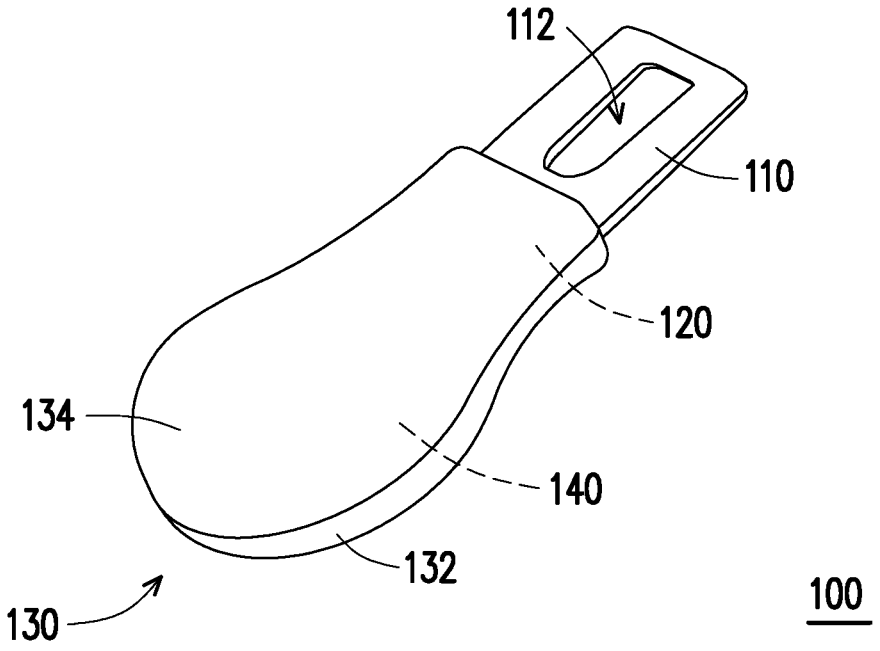

Next, FIG. 2B to FIG. 2D show a process of forming the handle part 130 sequentially on the insertion part 120 by the injection material, and mounting the electronic component 140 inside the handle part 130 in the process of forming the handle part 130 sequentially on the insertion part 120 by the injection material. The "forming the handle part 130 sequentially on the insertion part 120" means that the handle part 130 is divided into the first injection part 132 and the second injection part 134 and sequentially formed on the insertion part 120. The "mounting the electronic component 140 inside the handle part 130 in the process of forming the handle part 130 sequentially on the insertion part 120 by the injection material" means that the electronic component 140 is mounted between the first injection part 132 and the second injection part 134 between the process of forming the first injection part 132 and the process of forming the second injection part 134. Therefore, this process can be further broken down into three processes.

FIG. 2B shows the process of forming the first injection part 132 on the insertion part 120. In this process, the first injection part 132 is formed on the insertion part 120 by the injection material (such as rubber, but not limited thereto). Furthermore, the first injection part 132 has a receiving part 132*a* and a fixing part 132*b* corresponding to opposite two ends. The receiving part 132*a* is a concave structure for housing the electronic component 140, and the fixing part 132*b* is a convex structure for fixing the insertion part 120. In other words, a portion at one end of the first injection part 132 is recessed inward to form the receiving part 132*a*, and the shape/contour and size (such as length, width, radius, or depth) of the receiving part 132*a* substantially correspond to the shape/contour and size (such as length, width, radius, or thickness) of the electronic component 140, but not limited thereto, so as to house the electronic component 140 in the subsequent process. In addition, a portion at the other end of the first injection part 132 protrudes outward to form the fixing part 132*b*, and the size (such as length, width, or thickness) of the fixing part 132*b* is greater than the size (such as length, width, or thickness) of the insertion part 120, but not limited thereto, so as to fix the insertion part 120 in this process.

More specifically, the first injection part 132 is joined to the insertion part 120 by an injection molding process so that the insertion part 120 is fitted into the first injection part 132. That is, the insertion part 120 and the first injection part 132 are closely joined without a gap. In the first injection part 132, the size (such as length, width, or thickness) of the fixing part 132*b* is greater than the size (such as length, width, or thickness) of the insertion part 120. That is, the projection of the fixing part 132*b* in a plane can cover the projection of the insertion part 120 in the plane (as shown in FIG. 3). Further, the fixing part 132*b* is a convex structure that protrudes outward on the first injection part 132. That is, the first injection part 132 has a greater thickness at the portion corresponding to the fixing part 132*b* (as shown in FIG. 4). Therefore, the fixing part 132*b* can completely cover the insertion part 120. Moreover, the first injection part 132 formed on the insertion part 120 also covers and fills the openings 122 of the insertion part 120. That is, the insertion part 120 interferes with the fixing part 132*b* of the first injection part 132 through the openings 122. Thereby, the insertion part 120 can be stably fixed to the first injection part 132 (particularly, stably fixed to the fixing part 132*b*). However, the disclosure is not limited thereto. In other embodiments not shown, the protruding fixing part 132*b* may be omitted if the first injection part 132 can be joined to the insertion part 120.

Furthermore, in the present embodiment, the plate for constituting the ring part 110 and the insertion part 120 further has a neck 114 located between the ring part 110 and the insertion part 120. The width of the plate decreases from the ring part 110 toward the insertion part 120. That is, the width of the ring part 110 is greater than the width of the insertion part 120, and the neck 114 is at a position where the width of the plate changes. Preferably, the neck 114 is also disposed on the first injection part 132. That is, the ring part 110 of the plate is located outside the first injection part 132, and the neck 114 and the insertion part 120 are located in the first injection part 132, and the fixing of the insertion part 120 is further strengthened by the fixing part 132*b*. Thus, in the subsequent process of forming the second injection part 134, the insertion part 120 and the neck 114 are also fitted between the first injection part 132 and the second injection part 134. That is, the position where the width of the plate changes (the neck 114) is also buried inside the handle part 130. Therefore, the possibility of the insertion part 120 falling off from the handle part 130 can be reduced. However, the disclosure is not limited thereto. In other embodiments not shown, the plate may have a uniform width (that is, the width of the ring part 110 is equal to the width of the insertion part 120) or the width of the plate may increase from the ring part 110 toward the insertion part 120 (that is, the width of the ring part 110 is smaller than the width of the insertion part 120).

Next, FIG. 2C shows a process of mounting the electronic component 140 on the first injection part 132. In this process, the electronic component 140 is a radio frequency identification IC chip having a near field communication function, for example. With the near field communication technology, the user can wirelessly connect the pull 100 mounted with the electronic component 140 through a mobile device (such as a smart phone) to read data. The data may be data related to the slide fastener on which the pull 100 is used (such as manufacturing information and production history), data related to the garment (such as a jacket and a bag) on which the slide fastener is used (such as washing method, manufacturer information, and product information), or data related to the use of the garment (such as sports information or sports product-related information if the garment is a sports jacket), for example. In addition, the user can use the pull 100 mounted with the electronic component 140 as a proximity card (such as an access card or a rechargeable electronic wallet). The disclosure is not intended to limit the electronic component 140 to a certain type, which can be adjusted as required.

In the present embodiment, the electronic component 140 has an antenna part 142 corresponding to one surface of the electronic component 140 (the bottom surface as shown in FIG. 1), and the electronic component 140 is housed in the first injection part 132 with the antenna part 142 facing the first injection part 132. That is, before the electronic component 140 is housed in the first injection part 132, the first injection part 132 is already injection-molded on the insertion part 120 and is in a stable state (cooled and fixed in shape, for example). Therefore, when the electronic component 140 is housed in the first injection part 132 with the antenna part 142 facing the first injection part 132, the antenna part 142 of the electronic component 140 is not damaged by the heat generated by the injection molding of the first injection part 132, and the first injection part 132 can cover and protect the antenna part 142 of the electronic component 140.

In addition, "the electronic component 140 is housed in the first injection part 132" means that the electronic component 140 is housed in the receiving part 132*a* of the first injection part 132. Specifically, since the first injection part 132 has a concave structure as the receiving part 132*a*, the electronic component 140 can be placed in the concave structure that serves as the receiving part 132*a* and housed in the first injection part 132. Preferably, the shape/contour and size (such as length, width, radius, or depth) of the receiving part 132*a* correspond to the shape/contour and size (such as length, width, radius, or thickness) of the electronic component 140, so as to properly house the electronic component 140 in the receiving part 132*a* (the shape and depth of the receiving part 132*a* as shown in FIG. 2C correspond to the shape and thickness of the electronic component 140 so that the surface of the electronic component 140 and the surface of the first injection part 132 are flush with each other, but the disclosure is not limited thereto). That is, the electronic component 140 can be positioned in the first injection part 132 by the receiving part 132*a*, and the antenna part 142 of the electronic component 140 can be covered by the receiving part 132*a*. By forming the receiving part 132*a*, it is possible to prevent the electronic component 140 from shifting, and it is possible to protect the antenna part 142 and prevent the antenna part 142 from being affected and damaged by the second injection part 134 formed in the subsequent process (such as heat generated in the injection molding process). However, the disclosure is not limited thereto. In other embodiments not shown, the form of the receiving part 132*a* can be adjusted as required, or the receiving part 132*a* may be omitted.

Finally, FIG. 2D shows a process of forming the second injection part 134 on the first injection part 132 to bury the electronic component 140 without a gap. In this process, the second injection part 134 is formed on the first injection part 132 by the injection material (such as rubber, but not limited thereto) and buries the electronic component 140 that has been housed in the receiving part 132*a* of the first injection part 132 without a gap. Specifically, the second injection part 134 is joined to the first injection part 132 by an injection molding process so that the first injection part 132 and the second injection part 134 form the complete handle part 130. At this time, the handle part 130 is fixed on the insertion part 120, and the electronic component 140 is embedded therein.

More specifically, by the injection molding process, the insertion part 120 is closely joined with the handle part 130 (including the first injection part 132 and the second injection part 134) without a gap, and the electronic component 140 is also closely joined with the handle part 130 without a gap, but the insertion part 120 does not contact the electronic component 140. That is, the periphery of the electronic component 140 is completely covered by the injection material and is closely joined in the handle part 130. Thus, the waterproof and anti-bending effects of the electronic component 140 are achieved. Preferably, the size (such as length, width, or thickness) and shape/contour of the second injection part 134 correspond to the size (such as length, width, or thickness) and shape/contour of the first injection part 132 so that the handle part 130 has an aesthetic appearance. Alternatively, the surface of the second injection part 134 and/or the first injection part 132 may be provided with a decorative pattern (such as a trademark of the manufacturer or a mark representing the type of the electronic component 140) or a finger recess part for increasing the contact area between the user's finger and the handle part 130. In addition, in the process of dividing the handle part 130 into the first injection part 132 and the second injection part 134 and sequentially forming them on the insertion part 120, the color of the injection material may be changed for forming the first injection part 132 and the second injection part 134 so that the first injection part 132 and the second injection part 134 have different colors to form the design required. However, the disclosure is not limited thereto, and the above can be adjusted as required.

Furthermore, as described above, since the electronic component 140 is housed in the first injection part 132 with the antenna part 142 facing the first injection part 132, in the process of forming the second injection part 134 on the first injection part 132 to bury the electronic component 140 without a gap, the second injection part 134 does not contact the antenna part 142. Thus, the antenna part 142 of the electronic component 140 is unlikely to be affected and damaged by the heat generated during the injection molding of the second injection part 134.

In addition, in the process of forming the first injection part 132 as shown in FIG. 2B, the position where the width of the plate, which constitutes the ring part 110 and the insertion part 120, changes (that is, the neck 114) is also in the first injection part 132. Therefore, in the process of forming the second injection part 134 as shown in FIG. 2D, the neck 114 is also fitted between the first injection part 132 and the second injection part 134 and buried inside the handle part 130. Thereby, the possibility of the insertion part 120 falling off from the handle part 130 can be reduced. Further, since the width of the plate decreases from the ring part 110 toward the neck 114 and toward the insertion part 120, the handle part 130 is joined with the neck 114 and the insertion part 120 where the width of the plate is relatively small. Therefore, the portion of the handle part 130 close to the insertion part 120 and the neck 114 has flexibility, which can prevent the handle part 130 from being detached from the insertion part 120 under a force and prevent the electronic component 140 mounted in the handle part 130 from being bent and damaged. However, the disclosure is not limited thereto, and the above can be adjusted as required.

In summary, the pull of the disclosure can be used on a slider for a slide fastener and mounted with the electronic component, wherein the handle part is formed sequentially on the insertion part by the injection material, and the electronic component is mounted inside the handle part in the process of sequentially forming the handle part on the insertion part by the injection material. That is, since the handle part is formed sequentially on the insertion part by the injection material, the electronic component can be mounted on the injection material (such as the first injection part) that has already been formed on the insertion part when the injection material (such as the first injection part) is in a stable state (cooled and fixed in shape, for example). As the electronic component is protected by the injection material in a stable state (that is, the electronic component is housed in the concave structure that serves as the receiving part of the first injection part), the positioned and protected electronic component is then covered by the subsequently formed injection material (such as the second injection part) to be mounted inside the handle part. Thus, the electronic component can be mounted inside the handle part without being damaged, and therefore, the pull of the disclosure has favorable electronic functions.

It should be noted that the above embodiments are provided only to illustrate the technical solution of the disclosure and are not restrictive. Although the disclosure has been described in detail with reference to the above embodiments, it should be apparent to those skilled in the art that the technical solution described in the above embodiments may be modified, or some or all of the technical features may be replaced equivalently. Such modification and replacement do not depart from the scope of the technical solution of the embodiments of the disclosure.

What is claimed is:

1. A pull to be mounted on a slider for a slide fastener, comprising:

a ring part to be mounted on the slider;

an insertion part connected to the ring part for receiving an injection material;

a handle part formed sequentially on the insertion part by the injection material; and an electronic component mounted inside the handle part in a process in which the handle part is formed sequentially on the insertion part by the injection material.

2. The pull according to claim 1, wherein the handle part comprises a first injection part and a second injection part, wherein the first injection part is formed on the insertion part to house the electronic component, and the second injection part is formed on the first injection part to bury the electronic component without a gap.

3. The pull according to claim 2, wherein the insertion part has an opening, and the first injection part formed on the insertion part covers and fills the opening.

4. The pull according to claim 2, wherein the electronic component comprises an antenna part and is housed in the first injection part with the antenna part facing the first injection part so that the second injection part is not in contact with the antenna part.

5. The pull according to claim 2, wherein the first injection part comprises a receiving part and a fixing part corresponding to opposite two ends, wherein the receiving part is a concave structure for housing the electronic component, and the fixing part is a convex structure for fixing the insertion part.

6. A manufacturing method of a pull that is to be mounted on a slider for a slide fastener, the manufacturing method comprising:

providing a ring part to be mounted on the slider, and an insertion part connected to the ring part for receiving an injection material; and forming a handle part sequentially on the insertion part by the injection material, and mounting an electronic component inside the handle part in a process of forming the handle part sequentially on the insertion part by the injection material.

7. The manufacturing method of the pull according to claim 6, wherein the handle part comprises a first injection part and a second injection part, wherein in the process of forming the handle part sequentially on the insertion part by the injection material, the first injection part is formed on the insertion part to house the electronic component, and the second injection part is formed on the first injection part to bury the electronic component without a gap.

* * * * *